US007071399B2

(12) United States Patent
Ross

(10) Patent No.: US 7,071,399 B2
(45) Date of Patent: Jul. 4, 2006

(54) MOUTHPIECE, BARREL AND REED TABLE

(76) Inventor: Frank Anthony Ross, 6 Ciara Dr., New Castle, PA (US) 16105

( * ) Notice: Subject to any disclaimer, the term of this patent is extended or adjusted under 35 U.S.C. 154(b) by 83 days.

(21) Appl. No.: 10/799,300

(22) Filed: Mar. 11, 2004

(65) Prior Publication Data

US 2005/0211057 A1 Sep. 29, 2005

(51) Int. Cl.
*G10D 7/00* (2006.01)

(52) U.S. Cl. ..... 84/380 R; 206/314

(58) Field of Classification Search ..... 84/380 R, 84/383 R, 385 A; 206/314
See application file for complete search history.

(56) References Cited

U.S. PATENT DOCUMENTS 3,344,913 A * 10/1967 Best ..... 206/314
4,225,041 A * 9/1980 Lorenzini ..... 206/314

* cited by examiner

*Primary Examiner*—Kimberly Lockett
(74) *Attorney, Agent, or Firm*—Curtis L. Harrington

(57) ABSTRACT

A mouthpiece, barrel and reed table is provided as having at least one opening for supporting at least one mouthpiece, an extension for supporting at least one barrel section, and an optional table for supporting at least one reed in an organized manner. Variations including the use of a varying plurality of openings and extensions, with or without the optional reed table, to provide the user a variety of numbers of structures which can serve to fit in a variety of different sized available spaces. The basic member is a mouthpiece and barrel support structure, typically a volume of material, preferably a stylish stained hardwood, having at least one bore for supporting a mouthpiece and at least one barrel extension member for supporting a barrel. In the embodiment shown, the volume of material supports barrel and mouthpieces in a vertical position, but strict verticality is not necessary, and it may be that the position of support may vary along with the position of the external surface of the volume of material or structure upon which the mouthpiece and barrels will depend. The reed tray is angled with respect to the upper surface of the reed tray to permit reeds to be handled easily.

16 Claims, 2 Drawing Sheets

MOUTHPIECE, BARREL AND REED TABLE

FIELD OF THE INVENTION

The present invention relates to improvements the field of musical instrument organizational and convenience appliance. More specifically, the present invention relates to a mouthpiece, barrel and reed table appliance is for organizing, protecting and fashionably displaying musical mouthpieces, barrels and reeds, especially for wind instruments.

BACKGROUND OF THE INVENTION

Musicians, and particularly professional musicians having a plurality of instrument mouth pieces, reeds and barrels will interchange these elements while experimenting with different combinations and testing the compatibility and sound which may be producible based upon the particular combinations of the components at hand.

The use and quick interchangeability of a plurality of barrels, reeds and mouth pieces takes up a significant surface area, where the user is fortunate enough to have an extended surface area available. Even where the area is available, the user usually needs the space for sheet music and other cleaning and instrument use accessories.

Further, depending upon the surface finish of the available area, any moisture from the mouthpiece, barrel and reeds may spoil the surface on which they rest. Because the area in which such mouthpiece, barrel and reeds are place is not well defined, they tend to become scattered and may leak moisture on papers and other objects which could become damaged. Yet another related problem is that the available surface area for leaving mouthpieces and barrels might not be flat enough to prevent them from rolling off and becoming damaged.

SUMMARY OF THE INVENTION

A mouthpiece, barrel and reed table is provided as having at least one opening for supporting at least one mouthpiece, an extension for supporting at least one barrel section, and an optional table for supporting at least one reed in an organized manner. Variations including the use of a varying plurality of openings and extensions, with or without the optional reed table, to provide the user a variety of numbers of structures which can serve to fit in a variety of different sized available spaces.

The basic member is a mouthpiece and barrel support structure, typically a volume of material having at least one bore for supporting a mouthpiece and at least one barrel extension member for supporting a barrel. In the embodiment shown, the volume of material supports barrel and mouthpieces in a vertical position, but strict verticality is not necessary, and it may be that the position of support may vary along with the position of the external surface of the volume of material or structure upon which the mouthpiece and barrels will depend. An optional extended portion of the main body can be provided as a tray upon which reeds may be organizably placed.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
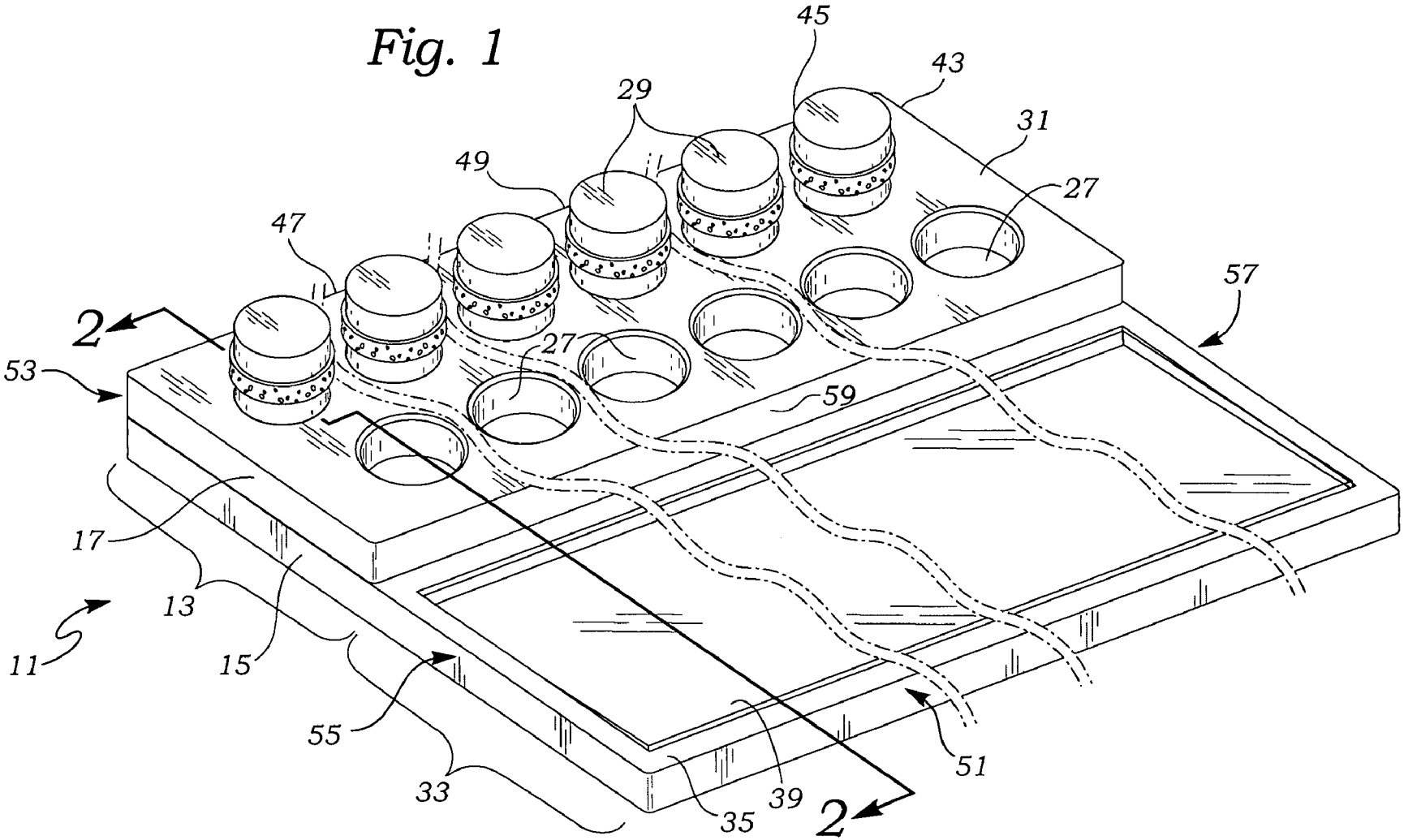
FIG. 1 is a perspective view of one embodiment of a mouthpiece, barrel and reed table.

The description and operation of the invention will be best described with reference to FIG. 1, which is a perspective view of one embodiment of a mouthpiece, barrel and reed table 11. The overall shape of mouthpiece, barrel and reed table 11 is a rectangular shape having two different height upper horizontal surfaces. A mouthpiece and barrel section 13 may be one portion of a base member 15. The other piece of mouthpiece and barrel section 13 may include an upper member 17. The bottom of mouthpiece, barrel and reed table 11 (not shown) may have an anti-skid bottom, attached dimple legs, or an anti-scratch felt pad for stability and protection of support surfaces.

The material of construction of the mouthpiece, barrel and reed table 11 may include plastic, wood, or metal. However, a rich stained hardwood has been found to form a particularly sturdy, attractive appliance which has sufficient weight to stabilize the implacement and removal of mouthpieces, barrels and reeds (not shown in FIG. 1). Users having the mouthpiece, barrel and reed table 11 can use it for (1) displaying a collection of mouthpieces, barrels and reeds; (2) as a help in holding for use the mouthpieces, barrels and reeds as the user interchanges them with respect to an instrument, and particularly where the user has limited working space; and (3) as a stable support platform which will lessen the chances of damage from mis-handling, from lateral damage from other objects, and especially from inadvertent rolling of mouthpieces and barrels.

The mouthpiece and barrel section 13 has an upper surface 25 which includes a plurality of circular bores 27 and a plurality of circular extensions 29. Each of the circular extensions 29 has a band of friction material 31, which may be preferably of cork, an elastomeric material or some other deformable material to engage an instrument barrel section (not shown).

A tray portion 33 is seen as having an upper surface 35. Tray portion 33 includes an inset portion 37 which supports a reed area as a smooth layer of plastic, or glass 39. Reed area need not be of plastic or glass 39, but can be made from the same material from which the overall mouthpiece, barrel and reed table 11 is made. Glass 39 is mounted at a tilt with regard to surface 35 in the direction of the mouthpiece and barrel section 13 in order to enable the tips of reeds (not shown) to avoid damage from being manually placed and slid forward across the area of upper surface 35 between the glass 39 and the front edge of the tray portion 33. With this modification, the user can place reeds with the thick ends in the direction of the mouthpiece and barrel section 13, the thin end toward the front edge of the tray portion 33 to insure that the thin end of the reed will not inadvertently abut any surface either during its being supported by the mouthpiece, barrel and reed table 11 or when being removed from the mouthpiece, barrel and reed table 11.

The tilt of the glass 39 combined with the unbalanced weight distribution of reeds will cause them to rest relatively stably along the rear edge of the glass 39 closer to the mouthpiece and barrel section 13. Selection by the sliding forward action is preferred as attempting to pick up the reeds laterally or from the rear end will be difficult, but the sliding forward action is facilitated not only by the tilt of the glass 39, but also by the low coefficient of friction of the reeds on the glass 39. There will be nothing to "catch" or "pick" the structure of the reeds.

FIG. 1 is shown with a first side portion 43 separated from a second side portion 45 to show the variability with which the mouthpiece and barrel section 13 can employ different numbers of circular bores 27 and circular extensions 29. As a starting point to show the multiple variability in the number of structures utilizable with the mouthpiece, barrel and reed table 11 and for visual purposes a first optional middle portion 47 which includes an additional circular bores 27 member and single circular extension 29 between them. A second optional middle portion 49 includes a pair additional circular bores 27 and a pair of circular extensions 29 between them. The middle portions 47 and 49 can be employed multiply, singly or in combination.

In the configuration of FIG. 1, the circular bores 27 are shown in even number with the circular extensions 29, but this need not be the case. The configuration of FIG. 1 also illustrates that the circular bores 27 are shown as being offset, having connecting centerlines (not shown) which are not parallel to any of the sides, namely front side 51, rear side 53, left side 55 nor right side 57, and front side 59 of the mouthpiece and barrel section 13. The offset configuration enables a bit lesser distance between front side 59 and rear side 53 at the expense of a little greater spacing between side 55 with respect to one of the circular bores 27 and circular extensions 29, and between side 57 with respect to the other of the circular bores 27 and circular extensions 29. Straight alignment is possible.

In terms of the construction of the mouthpiece, barrel and reed table 11, one piece of material may form the whole of the side 45 as a base member 15 with the mouthpiece and barrel section 13 being formed as second layer or upper member 17 added atop the base layer. Alternatively, the mouthpiece and barrel section 13 may be formed as one separate member with the tray portion 33 formed separately and then attached to the mouthpiece and barrel section 13.

The details of construction of one preferable embodiment include a dimensioning in which the circular bores 27 are have in internal diameter of 15/16 (fifteen sixteenths) of an inch in diameter. Where the mouthpiece and barrel section 13 is formed as a separate piece of material, as in upper member 17, the thickness of the upper member, which may approximately the same height as base member 15, and which is also preferably about three quarters of an inch thick, the circular bores 27 will preferably have that same depth of three quarters of an inch thick. This enables the circular bores 27 to be more easily formed as through bores.

The internal diameter of bores which accommodate the circular extensions 29 will be an internal diameter of twenty seven thirty seconds of an inch, to enable the sturdy inserted support of a dowel having a length of about 1 and seven eights inches and a three fourths inch outer diameter. The bottom layer of material, base 15 will have a thickness of about three fourths of an inch and will have a series of bores whose location and diameters match and align with the bores which accommodate the circular extensions 29.

The use of common, aligned bores enables the circular extensions 29 to act as reinforcing alignment pins which act to keep the base member 15 and upper member 17 affixed together and aligned. The circular extensions 29 are preferably solid, but may be annular, and the band of friction material 31 may be added to an even externally cylindrical shape, or in the alternative a groove may be provided to consistently register the height and vertically secure the band of friction material 31.

Figure 2:
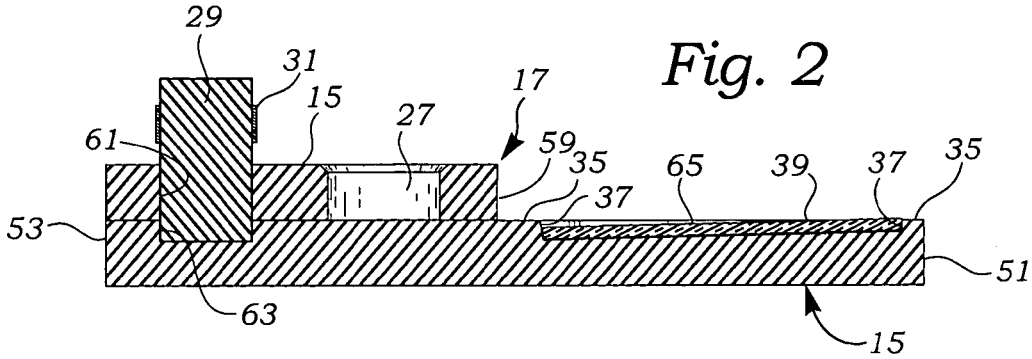
FIG. 2 is a section taken along line 2-2 of FIG. 1.

Referring to FIG. 2, a section taken along line 2—2 of FIG. 1 illustrates further details of construction. A bore 61 can be seen in the upper member 17 and aligning with a bore 63 in the base member 15, both of the bores 61 and 63 being engaged by the circular extension 29. As is seen underneath the glass 39, a slightly inclined slot 65 accommodates the glass 39 such that the edge or surface of the glass 39 at its edge nearer the front side 51 of the mouthpiece, barrel and reed table 11 is at least as high as and preferably higher than the upper surface 35 of the tray portion 33 between the glass 39 and the side 51. This will enable a substantially flat reed (not shown in FIG. 2) to slide atop the glass 39 toward the side 51 and pass over the surface 35 without interference.

The slot 65 contemplates the presence of the glass 39. An insulatory or padding material may be used between the glass 39 and slot 65, and string packing may be used to laterally fix the glass 39 into the slot 65 by lateral jamming insertion pressure. The possibility of using a material between glass 39 and slot 65 also opens the possibility to control the color tone of the reed area, as well as the possibility of adding logos and advertising.

If a material was utilized that was of sufficient moisture resilience, such that it was desired to eliminate glass 39, the slot 65 would have a depth which was raised by the thickness of the glass 39. The glass 39 of preferably utilization may be as thin as one-eighth of an inch thick, and if it were not used, the slot 65 would be raised on both forward and rearward end the same amount, about one-eighth of an inch where one-eighth inch thick glass is used, so that the surface could be used directly. The resulting slot 65 would have lost its vertical wall adjacent the upper surface 35 and the base of the slot 65 would likely form a shallow obtuse angle with respect to the upper surface 35.

Figure 3:
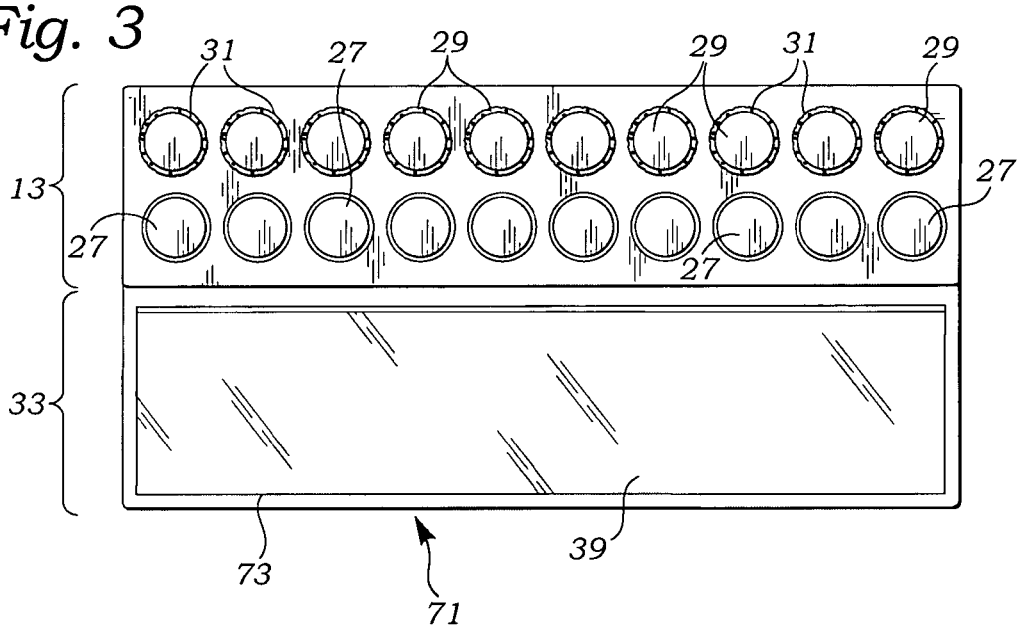
FIG. 3 is an example of a mouthpiece, barrel and reed table of FIG. 1, but shown as having ten circular bores and ten circular extensions.

Referring to FIG. 3, an example of a mouthpiece, barrel and reed table 71 is shown as having ten circular bores 27 and ten circular extensions 29. Any number can be employed, although the preferred embodiment will likely be barrel and reed table 11 which is shown as having six circular bores 27 and six circular extensions 29. The particulars of this embodiment, in addition to the dimensions already discussed above include an overall footprint dimension of about eleven inches by about ten and a half inches. The upper member 17 has a width of about eleven inches matching the width of base member 15, and a depth of about five and a half inches. The area of the inlay slot 65 is preferably about nine and one eighth inches wide by about four and three eighths inches depth to support glass 39 having a dimension of about eight and seven eighths inches wide by about four inches deep. The difference in area dimension occupied would be taken up by a suitable packing for keeping the glass 39 in place and would include a felt string or strip of leather approximately one eighth inch wide and about twenty six and three quarters of an inch long. The packing strip is seen in FIG. 3 as cord 73.

The reed area, that area generally occupied by the glass 39 has a depth in the direction of the mouthpiece and barrel section 13 of about four and three eights inches. A difference in height of three sixteenths of an inch minus one sixteenths of an inch over a depth of four and three eights inches amounts to a rise of about 0.125 inches over a run of four and three eights inches, or a slope of from about 0.02 to about 0.03.

Figure 4:
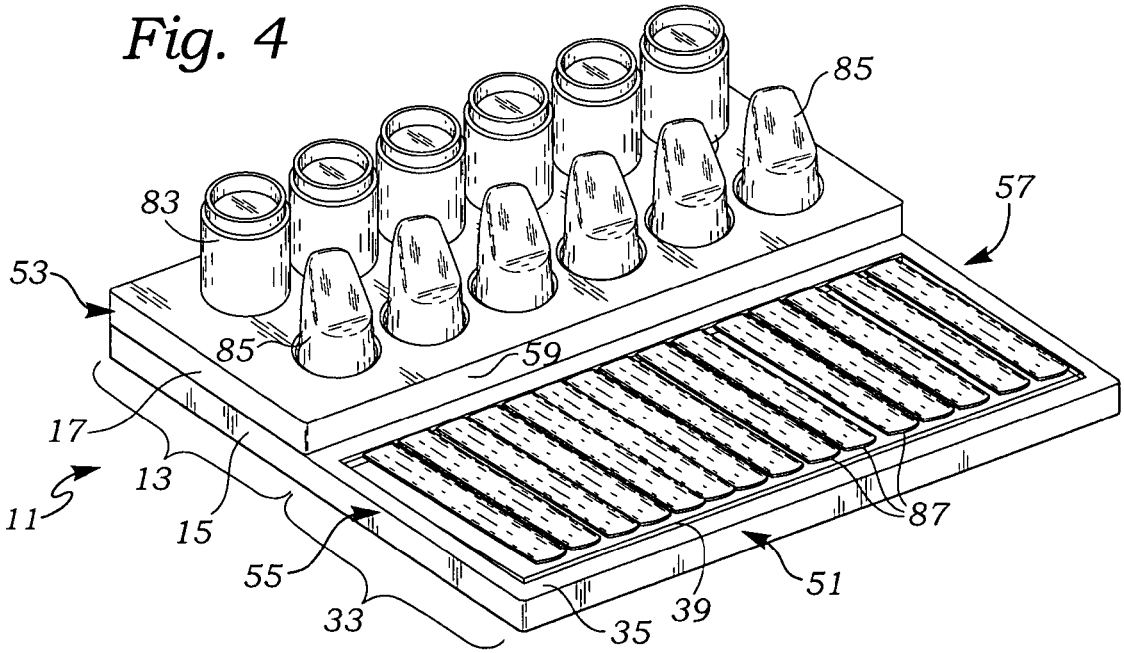
FIG. 4 is a perpective view of a mouthpiece, barrel and reed table having four circular bores and four circular extensions along with a set of sixteen reeds oriented with the thin end directed away from the mouthpiece and barrel section.

Referring to FIG. 4, a perspective view of a mouthpiece, barrel and reed table 11 having four circular bores 27 and four circular extensions 29 is shown along with a set of four barrels 83, four mouthpieces 85, and a set of sixteen reeds 87 oriented with the thin end directed away from the mouthpiece and barrel section 13.

While the present invention has been described in terms of an organizational, support, and display appliance, and in particular a device which assists musicians in holding, storing and interchanging instrument mouthpieces, reeds, and barrels, one of ordinary skill in the art can see that the device of the invention can take on a variety of overall spatial configurations and can be made from a variety of materials. The present invention may be applied in any situation where parts, particularly musical instrument parts may be supported, presented, interchanged and temporarily or permanently held to facilitate display, organization or for facilitating manual selection and interchange of instrument components to speed operation and facilitate organization.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A mouthpieces barrel and reed table comprising:

a body having a mouthpiece and barrel section having at least one circular bore for supporting a wind instrument barrel and at least one circular extension for supporting a wind instrument mouthpiece; and having a reed table section having a tray portion having a reed area and wherein said reed section area includes a glass plate.

2. The mouthpiece, barrel and reed table as recited in claim 1 and wherein said reed section area has an upper surface and wherein said glass plate has a side at least the same height as said upper surface.

3. A mouthpiece, barrel and reed table comprising:

a body having a mouthpiece and barrel section having at least one circular bore for supporting a wind instrument barrel and at least one circular extension for supporting a wind instrument mouthpiece; and having a reed table section having a tray portion having a reed area wherein said reed section area includes a upward sloped surface, in a direction near side of said mouthpiece, barrel and reed table, having a slope of from about 0.02 to about 0.03.

4. The mouthpiece, barrel and reed table as recited in claim 1 and wherein said at least one circular bore further comprises a plurality of circular bores.

5. The mouthpiece, barrel and reed table as recited in claim 1 and wherein said at least one circular extension further comprises a plurality of circular extensions.

6. A mouthpiece, barrel and reed table comprising:

a body having a mouthpiece and barrel section having at least one circular bore for supporting a wind instrument barrel and at least one circular extension for supporting a wind instrument mouthpiece; and having a reed table section having a tray portion having a reed area and wherein said at least one circular extension further comprises friction material attached to said at least one circular extension for firmly engaging a barrel.

7. A mouthpiece, barrel and reed table comprising:

a body having a mouthpiece and barrel section having at least one circular bore for supporting a wind instrument barrel and at least one circular extension for supporting a wind instrument mouthpiece; and having a reed table section having a tray portion having a reed area and wherein said body has a plurality of sides and wherein a line from an axis of said at least one circular extension to an axis of said at least one circular bore is angled with respect to at least one of said plurality of sides.

8. A mouthpiece, barrel and reed table comprising:

a body having a mouthpiece and barrel section having at least one circular bore for supporting a wind instrument barrel and at least one circular extension for supporting a wind instrument mouthpiece; and having a reed table section having a tray portion having a reed area and wherein said body has a base member which includes said reed area, and an upper member which includes said mouthpiece and barrel section.

9. The mouthpiece, barrel and reed table as recited in claim 3 and wherein said at least one circular bore further comprises a plurality of circular bores.

10. The mouthpiece, barrel and reed table as recited in claim 3 and wherein said at least one circular extension further comprises a plurality of circular extensions.

11. The mouthpiece, barrel and reed table as recited in claim 6 and wherein said at least one circular bore further comprises a plurality of circular bores.

12. The mouthpiece, barrel and reed table as recited in claim 6 and wherein said at least one circular extension further comprises a plurality of circular extensions.

13. The mouthpiece, barrel and reed table as recited in claim 7 and wherein said at least one circular bore further comprises a plurality of circular bores.

14. The mouthpiece, barrel and reed table as recited in claim 7 and wherein said at least one circular extension further comprises a plurality of circular extensions.

15. The mouthpiece, barrel and reed table as recited in claim 8 and wherein said at least one circular bore further comprises a plurality of circular bores.

16. The mouthpiece, barrel and reed table as recited in claim 8 and wherein said at least one circular extension further comprises a plurality of circular extensions.

* * * * *